US007507118B2

(12) United States Patent
Azuma et al.

(10) Patent No.: US 7,507,118 B2
(45) Date of Patent: Mar. 24, 2009

(54) CONNECTOR ASSEMBLY

(75) Inventors: Keiko Azuma, Shizuoka (JP); Kazuki Zaitsu, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/783,644

(22) Filed: Apr. 11, 2007

(65) Prior Publication Data

US 2007/0254513 A1 Nov. 1, 2007

(30) Foreign Application Priority Data

Apr. 28, 2006 (JP) ..... 2006-125760

(51) Int. Cl.
*H01R 13/40* (2006.01)

(52) U.S. Cl. ..... 439/587; 439/274; 439/701

(58) Field of Classification Search ..... 439/274, 439/275, 587, 588, 589, 271, 701
See application file for complete search history.

(56) References Cited

U.S. PATENT DOCUMENTS 4,998,896 A * 3/1991 Lundergan ..... 439/595
5,222,909 A * 6/1993 Nomura et al. ..... 439/607
6,174,201 B1 * 1/2001 Murakami et al. ..... 439/587
6,190,203 B1 * 2/2001 Murakami et al. ..... 439/587
6,368,130 B1 * 4/2002 Fukuda ..... 439/271
6,984,149 B2 * 1/2006 Fukuda et al. ..... 439/587

FOREIGN PATENT DOCUMENTS

JP 2000-294336 10/2000

* cited by examiner

*Primary Examiner*—Hien Vu
(74) *Attorney, Agent, or Firm*—Kratz, Quintos & Hanson, LLP

(57) ABSTRACT

The object of the invention is to provide a connector assembly having enough waterproof performance, without needing high insertion force during the assembly process. In accordance with the present invention, there is provided a connector assembly 1 comprising a plug assembly 7; a header assembly 5 configured to be mated with the plug assembly 7 while forming an opening between the plug assembly 7 and the inside of the header assembly 5; holder assemblies 18*d* and 18*e* configured to apply pressure on the plug assembly in the direction of insertion of the plug assembly 7 into the header assembly 5; and a sealing member 4 configured to be pushed out toward the opening in response to the pressure applied by the holder assemblies 18*d* and 18*e* after insertion of the plug assembly 7 into the header assembly 5, in order to plug and seal the opening.

2 Claims, 7 Drawing Sheets

CONNECTOR ASSEMBLY

BACKGROUND OF THE INVENTION (1) Field of the Invention

The present invention relates to a connector assembly. In particular, the present invention relates to a connector assembly having enhanced sealing performance between a plug assembly and a header assembly.

(2) Description of the Related Art

Various electronic components are mounted on an automobile, which is provided with a wiring harness for transmitting electric power or control signals to the electronic devices. The afore-mentioned wiring harness includes one or more electrical wires and connector assemblies. Conventionally, the electrical wire comprises an electrically conductive core wire and an electrically insulating outer layer.

As the connector as described above, for example, a connector assembly disclosed in Japanese Published Patent Application No. 2000-294336 can be used. Such a connector assembly includes a connector housing and a sealing member. The connector housing in turn includes a tubular outer case and a plurality of plate-like housings, which are provided with a terminal receiving groove for receiving a terminal fitting attached to an electrical wire.

The sealing member includes a plurality of sheet-like sealing pieces, each made of resilient materials such as rubber. The sheet-like sealing piece is attached to the plate-like housing so as to provide a seal for moisture around the electrical wire which is attached to the terminal fitting received in the terminal receiving groove of the plate-like housing.

The connector as described above can be assembled as follows. First, the terminal fitting attached to the electrical wire is received in the terminal receiving groove of the plate-like housing, and the sheet-like sealing pieces are attached to the plate-like housing. Thereafter, the plate-like housings are engaged with each other and then the same plate-like housings are received in an outer case. Finally, the resulting connector as mentioned above is coupled to a mating connector. During the connector as mentioned above, the sheet-like sealing pieces protect the electrical wire against moisture so as to prevent moisture and the like from entering the terminal receiving groove via the electrical wire.

During the above referenced connector, while the sheet-like sealing pieces, each made of rubber and the like having restitution property, are used in order to ensure that moisture does not pass into both the outer case and the housing, a drawback of the connector is that more force is needed to insert the housing into the outer case. In other word, difficulty of insertion operation as mentioned above is problematic. One proposed method of overcoming the high insertion force was to control restitution property of the sealing piece. Unfortunately, in such a case, it was found to be impossible to provide a connector assembly with enough waterproof performance.

Thus, a need exists for an improved electrical connector assembly, which has enough waterproof performance, as well as, does not need high insertion force when the housing is mated into the outer case.

SUMMARY OF THE INVENTION

In accordance with an embodiment of the present invention, a connector assembly comprises a plug assembly; a header assembly configured to be mated with the plug assembly while forming an opening between the plug assembly and the inside of the header assembly; a holder configured to be pressed in the direction of insertion of the plug assembly into the header assembly; and a sealing member configured to be pushed out in a direction to fill the opening in response to the pressure applied by the holder after insertion of the plug assembly into the header assembly, in order to plug and seal the opening.

During the afore-mentioned connector assembly, the plug assembly is mated with the header assembly, while forming the opening between the plug assembly and the inside of the header assembly. Thereafter, the sealing member is pushed out in a direction to fill the opening in response to the pressure applied by the holder in the direction of insertion of the plug assembly into the header assembly. Such a configuration enables the sealing member to plug and seal the opening.

In accordance with another embodiment of the present invention, the afore-mentioned connector assembly can further comprise a positioning device configured to ensure proper positioning of the holder in order to enable the sealing member to plug and seal the opening.

Due to afore-mentioned configuration of the positioning device, the holder can be positioned in a desired position. Accordingly, the sealing member is securely pushed out in response to the pressure applied by the holder, leaving no opening at all between the plug assembly and the header assembly.

In accordance with yet another embodiment of the present invention, during the afore-mentioned connector assembly, the plug assembly can comprise the plug assembly comprises a holder base positioned at an end of the holder, and one or more holders layered upon the holder base.

The connector assembly comprising a plug assembly which has the holder base and the one or more holders layered thereupon, enables the sealing member to plug and seal the opening which exists between the multi-layered holders and the header assembly, more efficiently.

Figure 1:
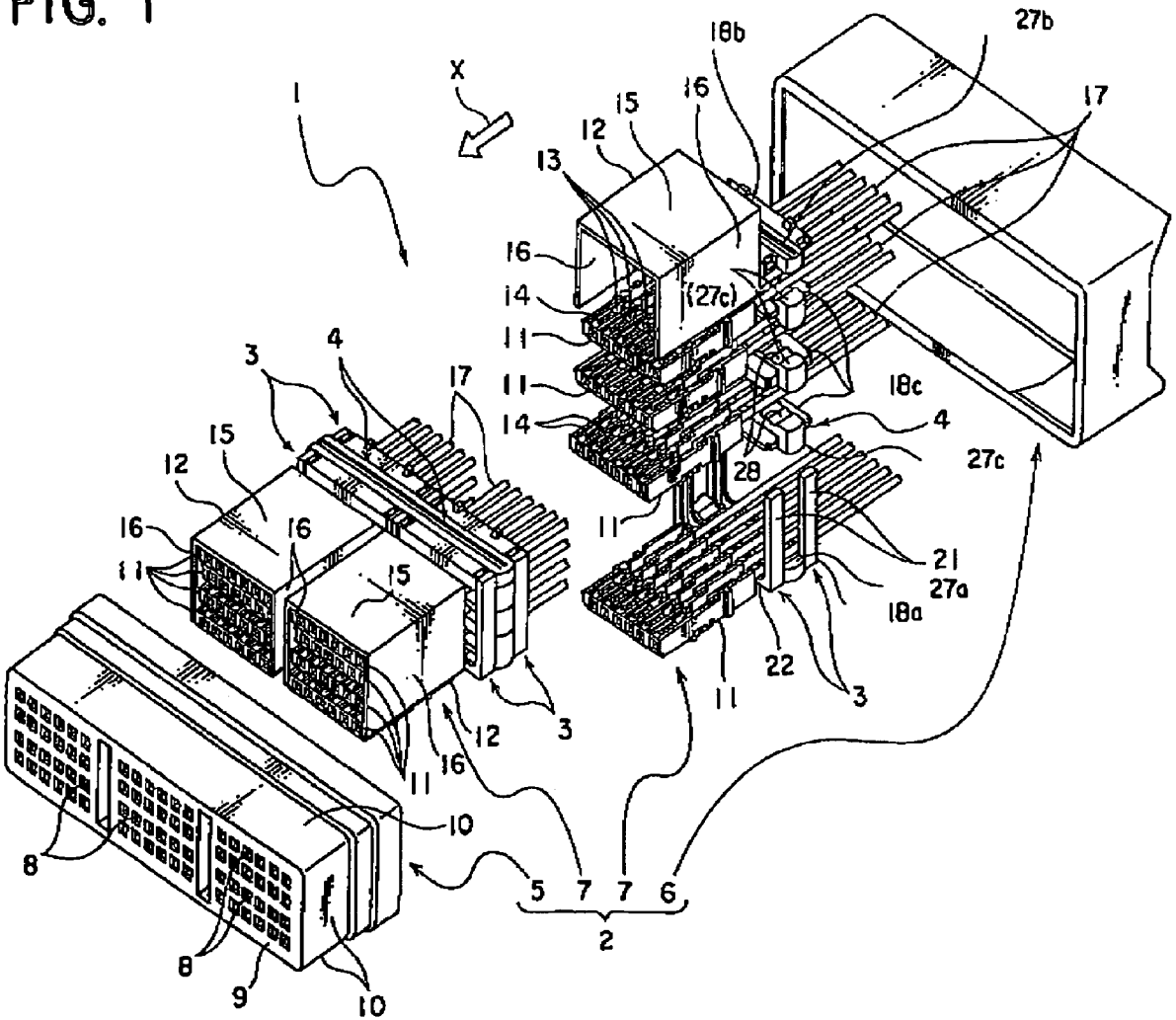
FIG. 1 is an exploded perspective view of a connector assembly according to an embodiment of the present invention.

The foregoing summary, as well as the following detailed description of certain embodiments of the present invention, will be better understood when read in conjunction with the appended FIGS. 1-10. For the purpose of illustrating the invention, there is shown in the drawings, certain embodiments. It should be understood, however, that the present invention is by no means limited by the appended drawings.

DESCRIPTION OF THE PREFERRED EMBODIMENTS

Referring to FIGS. 1-4, a connector assembly 1 comprises a connector housing 2, at least one pair of holder assemblies 3, and at least one sealing member 4. The connector housing 2 comprises a header assembly 5, an outer case 6, at least one plug assembly 7 as a male block, and a positioning device 60 (i.e., a positioning area) as a positioning means.

The header assembly 5 is formed of electrically insulating materials such as synthetic resin, and formed into a tubular shape, comprising an oppositely facing wall 9 having a plurality of holes 8 through which the male tab of the male terminal of a mating connector to be mated with the connector assembly 1 are passed, and a plurality of side walls 10, each of which extends from each edge of the oppositely facing wall 9 in a direction perpendicular to the wall 9. Space inside the header assembly 5 is divided into several compartments, for example, three compartments in accordance with an embodiment of the present invention.

The outer case 6 is formed of electrically insulating materials such as synthetic resin and formed into a tubular shape. The outer case 6 is secured to the header assembly 5 while receiving the header assembly 5 and the plug assembly 7 therein.

In accordance with an embodiment of the present invention, there are provided three plug assemblies 7. As viewed in FIGS. 1 and 3, the plug assembly 7 comprises a plurality of plate-like housings 11 and a cover 12. The plug assembly 7 comprises four plate-like housings 11 in FIGS. 1 and 3. The plate-like housing 11 is formed of electrically insulating materials such synthetic resin, and formed into a plate shape. The plate-like housing 11 comprises a plurality of terminal receiving grooves 14 for receiving terminal fittings 13 (shown in FIG. 3). A plurality of terminal receiving grooves 14 are formed with recesses on the exterior surface of the plate-like housing 11, and are arranged in parallel to one another. The plate-like housings 11 are layered upon one another.

The cover 12 is formed of electrically insulating materials such as synthetic resin, and formed into a C-shape, including a flat top wall 15, and side walls 16 extending from each edges of the top wall 15 in a direction perpendicular to the top wall 15. The cover 12 is layered on top of the multi-layered plate-like housings 11 such that the top wall 15 plugs the terminal receiving groove 14 of the plate-like housing 11, is also positioned in order to accommodate a plurality of plate-like housings 11 between a pair of side walls 16, and is secured to the plate-like housings 11. During the plug assembly 7, the plate-like housings 11 configured to receive the terminal fitting 13 attached to the electrical wire 17 into the terminal receiving groove 14, are layered upon one another, are covered with the cover 12, and are secured to the cover 12.

Figure 4:
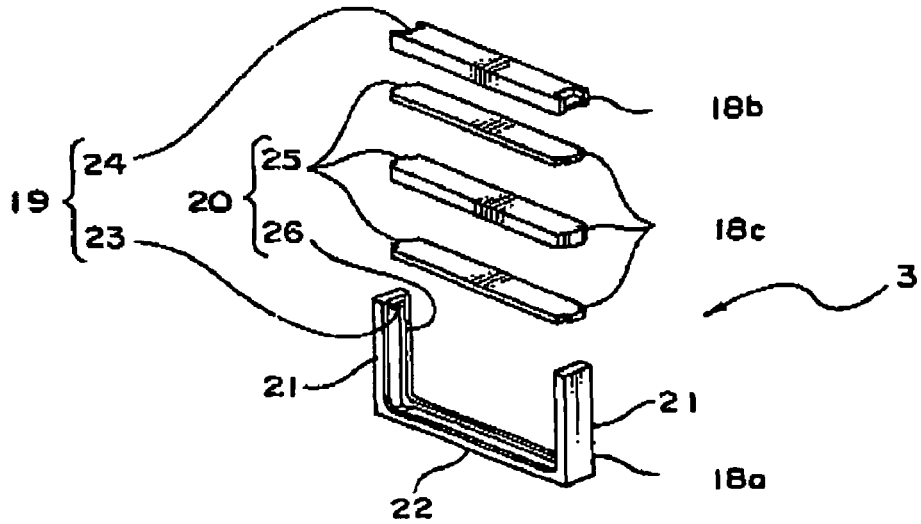
FIG. 4 is an exploded perspective view of a rear holder of the connector assembly of FIG. 1.

The rear holder 3 is formed of electrically insulating materials such as hard-type synthetic resin which does not resiliently deform. Each plug assembly 7 in accordance with an embodiment of the present invention includes a pair of holder assemblies 3. As shown in FIG. 4, each of holder assemblies 3 comprises a holder assembly 18 (shown as a base holder 18*a*, top holder 18*b* and intermediate holders 18*c*), an engaging section 19, and a guiding section 20. The holder assemblies 3, for example, may include five holders 18*a*, 18*b* and 18*c*.

Figure 5:
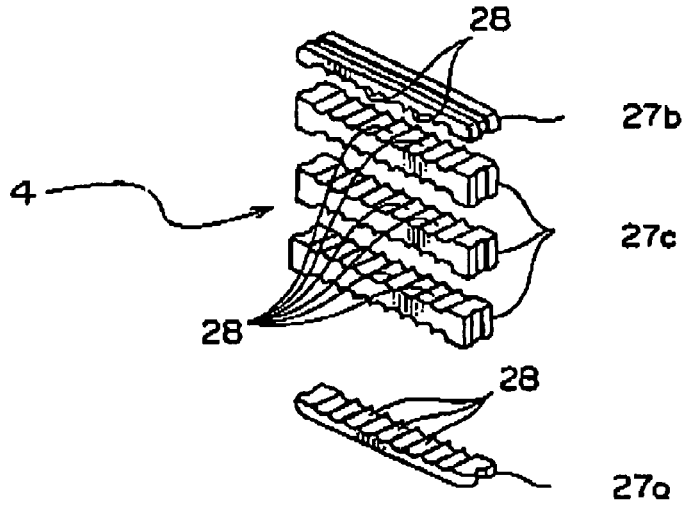
FIG. 5 is an exploded perspective view of a sealing member of the connector assembly of FIG. 1.

In accordance with an embodiment of the present invention, a plurality of holders are layered upon one another, and are positioned at one end of the holder assembly 3. As shown in FIGS. 4 and 5, the base holder 18*a* includes a pair of rails 21 which are arranged in parallel to each other, and a bar-shaped connecting section 22 configured to connect one ends of the rails 21 to each other, and is formed into a C-shape. Each of rails 21 is extending from the respective end of the connecting section 22 in a direction toward the intermediate holders 18*c*, and is formed into a bar-shape. The rails 21 are arranged in parallel to each other, while maintaining spaced-apart relationship.

The other four holders (top holder 18*b* and intermediate holders 18*c*) are formed into a bar-shape extending in their horizontal direction respectively. These four holders are arranged between a pair of rails 21, being parallel to the connecting section 22. The four holders 18*b* and 18*c* are arranged in parallel to one another, are spaced from one another, and are layered upon the holder base.

Referring to FIG. 4, the engaging section 19 comprises an engaging protuberance 23 located at the opposite end of the rail 21 (i.e. the end situated away from the connecting section 22), and a engaging recess 24 formed at both ends of the top holder 18*b* in the longitudinal direction, wherein the top holder 18*b* is placed farthest away from the connecting section 22 of the base holder 18*a*. In other words, a plurality of the engaging section 19 are located at the opposite ends of the rails 21 (i.e., the ends other than the ends adjacent to the connecting section 22) and both ends of the top holder 18*b*. The engaging protuberance 23 is blade-like protuberance extending from the opposite end of the rail 21 in a direction toward the oppositely facing rail 21. The top holder 18*b* has the engaging recess 24 at its both ends in the longitudinal direction. When the engaging protuberance 23 is received in engaging recess 24, the both ends of the top holder 18*b* and the opposite ends of the rails 21 are engaged respectively in the engaging section 19.

The guiding section 20 comprises a guiding protuberance 25 located at both ends of the intermediate holders 18*c* other than base holder 18*a* and top holder 18*b* in its longitudinal direction, and a guiding groove 26 located at a pair of rails 21. In other words, the guiding section 20 is formed extending from the intermediate holders 18*c* to the rail 21.

The guiding protuberance 25 is formed projecting from both ends of the intermediate holders 18*c* in its longitudinal direction. The guiding groove 26 is recessed from the oppositely facing surfaces of a pair of rails 21. The guiding groove 26 is disposed along the longitudinal direction of the rail 21, and limited by the whole length of the rail 21. By the presence of the guiding groove 26, the cross section of the rail 21 represents a C-shape. Because the guiding protuberance 26 is received in the guiding groove 26, the guiding section 20 supports the intermediate holders 18*c* such that the holders 18*c* may move freely along the guiding groove 26 (i.e., the longitudinal direction of the rail 21).

After the connecting section 22 of the base holder 18*a* and the intermediate holders 18*c* are arranged in parallel to one another, the intermediate holders 18*c* are press-fitted between a pair of rails 21. At this point, the guiding protuberance 25 of the intermediate holders 18*c* is in turn inserted into the guiding groove 26 of the base holder 18*a*. Next, the intermediate holders 18*c* are press-fitted between a pair of rails 21. When the guiding protuberance 25 of the intermediate holders 18*c* is received in the corresponding guiding groove 26, the intermediate holders 18*c* can move freely along the longitudinal direction of the rail 21.

Further, by press-fitting the top holder 18*b* between a pair of rails 21, the engaging protuberance 23 can be received in the engaging recess 24. After the connecting section 22 and the top holder 18*b* and intermediate holders 18*c* are arranged in parallel to one another while maintaining spaced-apart relationship, the rear holder 3 can be assembled thereto. Accordingly, such an assembled rear holder 3 not only can be attached to the plug assembly 7 together with the sealing member 4, but also can be press-fitted into the outer case 6 together with the plug assembly 7, and is finally coupled to the connector housing 2. When the rear holder 3 is coupled to the connector housing 2, the electrical wire 17 is positioned among the base, top and intermediate holders 18*a*, 18*b* and 18*c*.

The sealing member 4 is formed of resilient materials such as rubber. The sealing member 4 is, for example, provided within the plug assembly 7. As shown in FIG. 5, the sealing member 4 includes a plurality of sealing pieces 27 (shown as base sealing piece 27*a*, top sealing piece 27*b* and intermediate sealing piece 27*c*). In accordance with an embodiment of the present invention, the sealing member 4 can include five sealing pieces 27.

Each of sealing pieces 27 is formed into a bar-shape. The sealing pieces 27 are arranged in parallel to one another, having spaced-apart relationship. The base sealing piece 27*a* situated at the bottom among a plurality of sealing pieces (refer FIG. 5) includes a plurality of grooves 28 formed on its surface opposed to the other sealing pieces 27*b* and 27*e*. Each of grooves 28 is recessed from the surface of the base sealing piece 27*a*, representing an arc-shape in cross section. A plurality of grooves 28 are arranged in a row along the longitudinal direction of the base sealing piece 27*a*. Each of grooves 28 extends along the width direction of the sealing piece 27*a*.

A top sealing piece 27*b* situated at the highest point among a plurality of sealing pieces (refer FIG. 5) includes a plurality of grooves 28 formed on its surface opposed to the other sealing pieces 27*a* and 27*c*. Each of the intermediate sealing pieces 27*c* includes a plurality of grooves 28 on its upper surface and under surface. In other words, each of the intermediate sealing pieces 27*c* includes a plurality of grooves 28 on its surface which is opposed to the sealing piece 27*a*, 27*b* or 27*c*. The electrical wire can pass through the sealing pieces 27*a*, 27*b* and 27*c* via the afore-mentioned grooves 28.

By means of an adhesive and the like, two base holders 18*a* are attached to the base sealing piece 27*a*, two holders 18*b* are attached to the top sealing piece 27*b*, and two holders 18*c* are attached to each of remaining intermediate sealing pieces 27*c*, respectively. At this point, the base sealing piece 27*a* is positioned between two holders 18*a* along the longitudinal direction of the grooves 28. Similar to the base sealing piece 27*a*, the sealing pieces 27*b* and 27*c* are also positioned between two holders 18*b* and between two holders 18*c*, respectively. In this way, the sealing pieces 27*a*, 27*b* and 27*c* are attached to the respective holders 18*a*, 18*b* and 18*c*, respectively.

In addition, when the intermediate holders 18*c* are layered upon the connecting section 22 of the base holder 18*a*, the intermediate sealing pieces 27*c* are in turn layered upon the base sealing piece 27*a*. Finally, when the top holder 18*b* is layered upon the intermediate holders 18*c*, the top sealing piece 27*b* is layered upon the intermediate sealing piece 27*c*.

As the holder assembly 3 is assembled, simultaneously the sealing pieces 27*a*, 27*b* and 27*c* are in turn layered, to provide the sealing member 4.

Figure 9:
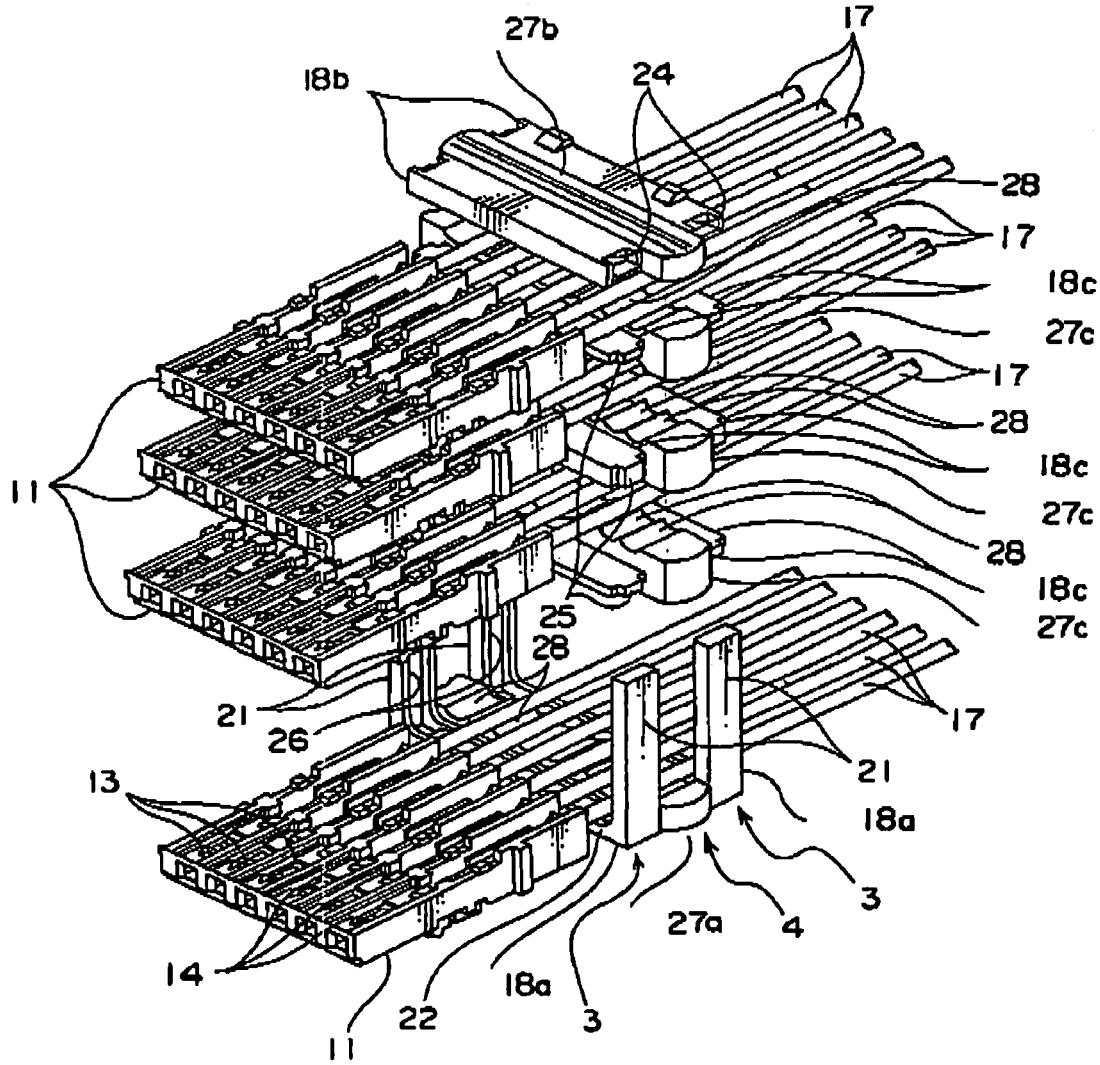
FIG. 9 is a partially exploded perspective view of a plug assembly during the connector assembly of FIG. 1.

At this point, as shown in FIG. 9, the electrical wire 17 attached to the terminal fitting 13 which is received within the terminal receiving groove 14 of the plate-like housing 11, is positioned among the sealing pieces 27*a*, 27*b* and 27*c*. Precisely, the electrical wire 17 is positioned inside afore-mentioned groove 28.

Figure 2A:
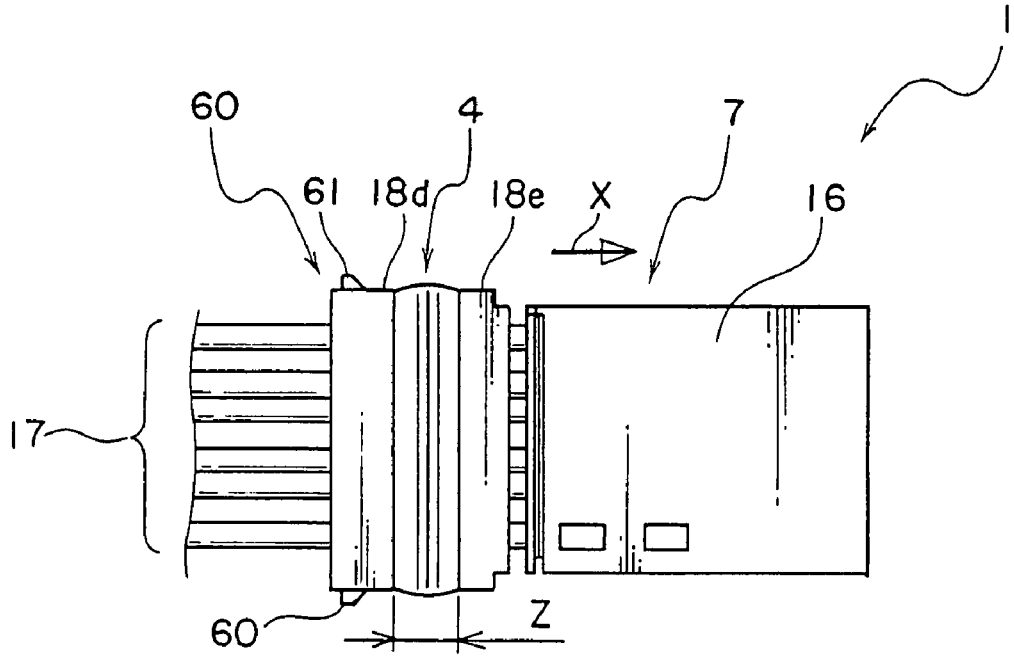
FIG. 2A is a side view illustrating a behavior of a sealing member according to an embodiment of the present invention prior to mating of the connector assemblies.

The sealing pieces 27*a*, 27*b* and 27*c* are clipped on the base holder 18*a*. The side 27*d* of the sealing piece 27*a*, 27*b* or 27*c* represents, as shown in FIG. 2A, an arc-shape in cross section in the direction of arrow X (i.e., insertion direction), and the corresponding circumferential plane and the holder 18*a* are substantially coplanar. In other words, even if the sealing member 4 comprising the sealing pieces 27*a*, 27*b* and 27*c* is inserted into the header assembly 5, it still comes into contact with the inner surface of the header assembly 5, and therefore prevents the restitution force from occurring.

Figure 2B:
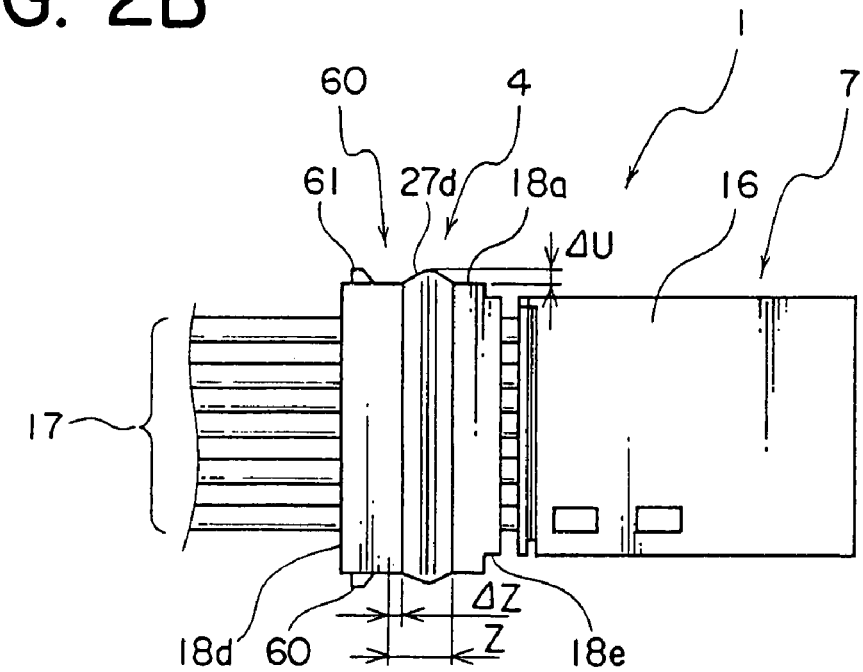
FIG. 2B is a side view illustrating a behavior of a sealing member according to an embodiment of the present invention after mating of the connector assemblies.

When the sealing pieces 27*a*, 27*b* and 27*c* are inserted into the header assembly 5, the holder 18*d* is pressed in a direction of X (i.e., insertion direction) and then the sealing pieces are sandwiched between the holders 18*d* and 18*e* of the plug assembly 7. As a result, the sealing pieces 27*a*, 27*b* and 27*c* are compressed, and, as viewed in FIG. 2B, are pushed out from the surface of the base holder 18*a* in a direction toward the inside of the header assembly 5 to an extent of Au to form a protuberance portion 27*d*, which acts to plug and seal the opening 50 that exists between the header assembly 5 and the plug assembly 7 (refer FIG. 3), thereby ensuring that moisture cannot pass into said opening.

Figure 3:
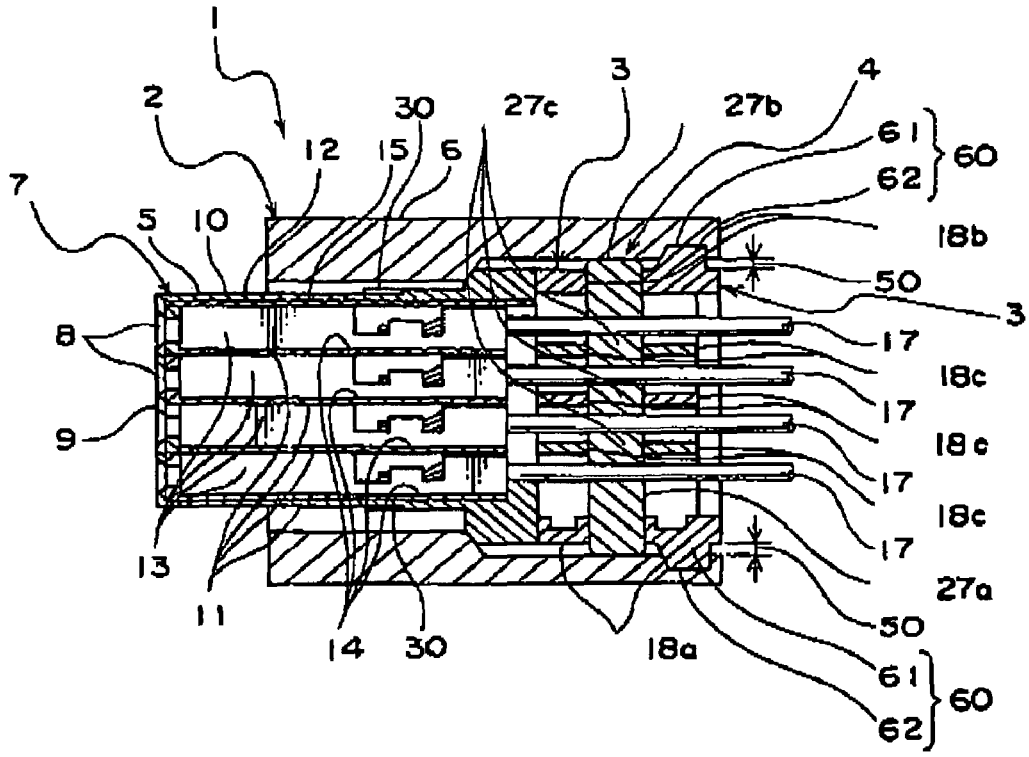
FIG. 3 is a cross sectional view of the connector assembly of FIG. 1.

The afore-mentioned positioning device 60 includes an engaging section 61 and an engaging recess 62. The engaging section 61 is formed in a pair on both upper surface and under surface of the holder 18*d*. As shown in FIG. 3, the engaging recess 62 is formed corresponding to the shape of the engaging section 61 on the inner surface of the header assembly 5. In cases where the sealing member 4 has a width of "Z", as shown in FIG. 2B, when the sealing member 4 is compressed by the holder 18*d* to an extent of ?u, the engaging recess 62 is positioned such that it may be engaged with the engaging section 61. Because of afore-mentioned compression, the sealing member 4 are pushed out from the surface of the holder 18*a* in a direction toward the inside of the header assembly 5 to an extent of ?u, allowing the opening 50 to be securely plugged. In addition, the positioning area 60 may be designed depending on elasticity of the sealing member 4.

Moreover, for example, the sealing member 4 can be embedded between the holder 18*f* and 18*e*, or between the holder 18*d* and the plug assembly 7 in the absence of holder 18*e*. The engaging recess 62 of the positioning device 60 may be formed in the outer case 6, as the case may be.

The plug assembly 7 is assembled, and then the rear holder 3 and the sealing member 4 are attached to the plug assembly 7, to provide the above mentioned connector assembly 1. The terminal fitting 13 attached to the electrical wire 17 is press-fitted into the terminal receiving groove 14 of the plate-like housing 11. Subsequently, the terminal fitting 13 attached to the electrical wire 17 is assembled to the plate-like housing 11.

Figure 6:
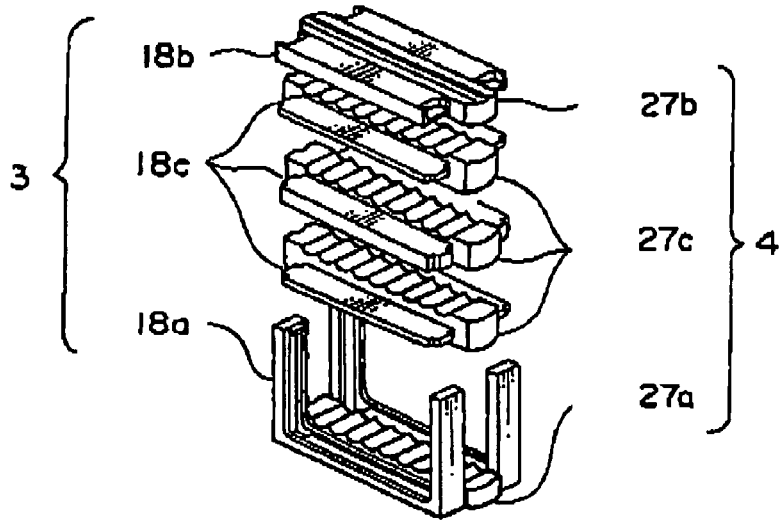
FIG. 6 is a perspective view illustrating the manner in which the holders of the rear holder of FIG. 4 and the sealing pieces of the sealing member of FIG. 5 are assembled to one another.
Figure 7:
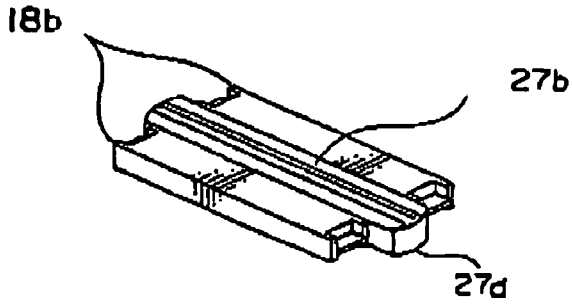
FIG. 7 is a perspective view illustrating an assembly of the holder and the sealing piece of FIG. 6.
Figure 8:
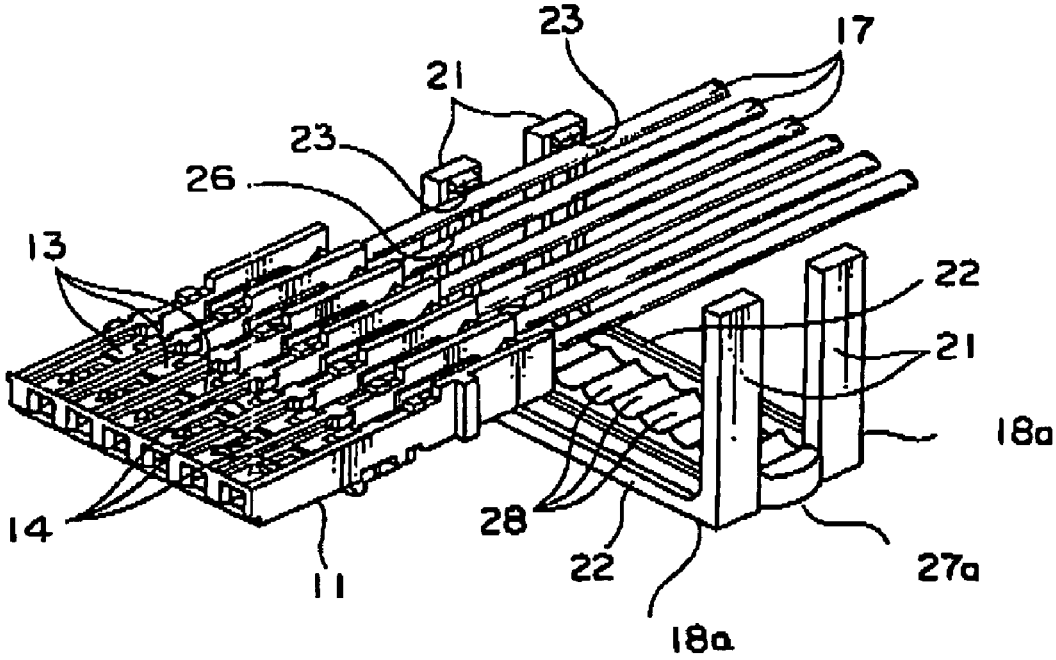
FIG. 8 is a perspective view illustrating the manner in which the assembly of the holder and the sealing piece, as shown in FIG. 6, and a plate-like housing are assembled to each other.

As shown in FIGS. 6 and 7, by means of an adhesive and the like, two base holders 18*a* are attached to the base sealing piece 27*a*, two top holders 18*b* are attached to the top sealing piece 27*b*, and two intermediate holders 18*c* are attached to the intermediate sealing piece 27*c*, respectively. Then, as shown in FIG. 8, the plate-like housing 11 is attached to the base sealing piece 27*a* and the base holder 18*a* in such a manner that the electrical wire 17 is put inside the groove 28 of the base sealing piece 27*a*. After the top sealing piece 27*b* is layered upon the electrical wire 17 inside the plate-like housing 11, the electrical wire 17 of the other plate-like housing 11 is layered upon the afore-mentioned assembly. As a result, as shown in FIG. 9, the sealing pieces 27*a*, 27*b* and 27*c*, and the plate-like housings 11 are alternately layered, thereby sandwiching the plate-like housing 11 between two sealing pieces.

Figure 10:
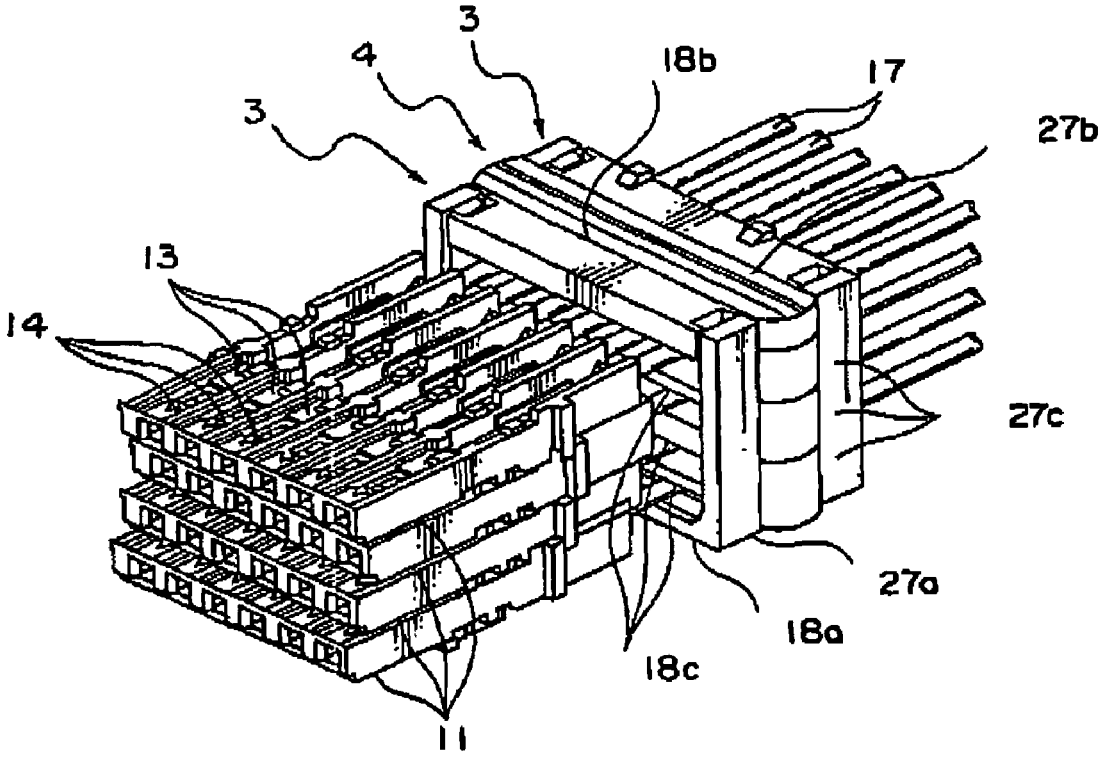
FIG. 10 is a perspective view illustrating the manner in which plate-like housings of the plug assembly of FIG. 9 are assembled to one another.

Thereafter, a plurality of plate-like housings 11 are pressed such that the plate-like housings 11 may approach one another to form the assembly of the plate-like housings 11. In addition, the base holders 18*a* and top holders 18*b* are fixed to each other by way of the engaging section 19 in order to assemble the base, top and intermediate holders 18*a*, 18*b* and 18*c* as well as to assemble the sealing pieces 27*a*, 27*b* and 27*c*. As shown in FIG. 10, the rear holder 3 and the sealing member 4 are attached to a plurality of plate-like housings 11 which have already been assembled to one another. Thereafter, the cover 12 is attached to the afore-mentioned assembly. In this way, the plug assembly 7 is assembled, and then the rear holders 3 and the sealing member 4 are also assembled to the plug assembly 7. In addition, a ring-like perimeter seal 30 is positioned around the plug assembly 7, thereby providing the connector assembly 1 with enhanced sealing performance according to the present invention.

After the plug assembly 7 is inserted into the header assembly 5, the plug assembly 7, the rear holder 3 and the sealing member 4 are press-fitted to the outer case 6 in the direction of "X" (i.e., insertion direction). As this occurs, the engaging section 61 of the positioning device 60 will be inserted into the engaging recess 62. The sealing member 4 will be compressed and then pushed out from the surface of the holder 18*a* in a direction toward the inside of the header assembly 5, forming the protuberance portion 27*d*. Such a protuberance portion 27*d* can plug and seal the opening 50 which has been formed between the header assembly 5 and the plug assembly 7, thereby ensuring that moisture cannot pass into the opening therebetween within the connector assembly 1.

The connector assembly 1 assembled as described above can be coupled to a mating connector. Such an assembly may be used with an automobile wiring harness system.

In accordance with the embodiment of the present invention, since the connector assembly 1 is designed to plug and seal the opening 50 which exists between the header assembly 5 and the plug assembly 7 by means of the sealing member 4, which is pushed out in a direction toward the opening 50 as mentioned above, in cases where the plug assembly 7 is inserted into the header assembly 5, the restitution phenomenon of the sealing member 4 will not occur, and said opening can be securely plugged. As a result, it is possible to provide a connector having enhanced sealing performance, as well as considerably decreased insertion force during the assembly process.

Moreover, because the holder assembly 18*d* is positioned such that the sealing member 4, regardless of its restitution force, may plug and seal the opening 50 which exists between the plug assembly 7 and the header assembly 5, improved sealing performance can be achieved between the plug assembly 7 and the header assembly 5.

Further, even if the plug assembly 7 includes a plurality of plate-like housings 11 (i.e., the multi-layered holders), the opening between the plug assembly 7 and the header assembly 5 can be plugged securely. Therefore, it is possible to provide a connector having enhanced sealing performance, as well as considerably decreased insertion force during the assembly process.

In accordance with the embodiment of the present invention, the sealing pieces (27*a*, 27*b* and 27*c*) which constitute the sealing member 4 are attached to the base holder, top holder and intermediate holders (18*a*, 18*b* and 18*c*) which constitute the rear holder 3, by means of an adhesive and the like. However, the sealing pieces 27*a*, 27*b* and 27*c* may also be molded integrally with the base holder, top holder and intermediate holders 18*a*, 18*b* and 18*c*, for example, by insert molding.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A connector assembly, comprising:

a plug assembly;

a header assembly configured to be mated with the plug assembly with an opening between the plug assembly and the inside of the header assembly;

an outer case secured to the header assembly while receiving the header assembly and plug assembly therein;

a holder assembly at least partly forming the plug assembly; and a sealing member at least partly forming the plug assembly, wherein the holder assembly comprises a pair of top holders, at least one pair of intermediate holders and a pair of base holders; the sealing member comprises a top sealing piece, at least one intermediate sealing piece, and a base sealing piece; each of the holders is made of resiliently undeformable material; each of the sealing pieces is made of resilient material; the pair of top holders is respectively attached to both opposing faces of the top sealing piece, the respective pair of intermediate holders is respectively attached to both opposing faces of the respective intermediate sealing piece, and the pair of base holders is respectively attached to the base sealing piece, the at least one intermediate sealing piece is interposed between the base sealing piece and the top sealing piece, and the top sealing piece, the at least one intermediate sealing piece, and the base sealing piece are secured to one another; each of the sealing pieces is configured to be compressed between the pair of holders attached to the corresponding sealing piece in the direction of insertion of the plug assembly, upon insertion of the plug assembly into the header assembly, and is configured to be pushed out in a direction perpendicular to the direction of insertion of the plug assembly to form a protrusion and to seal the opening, after insertion of the plug assembly into the header assembly.

2. The connector assembly according to claim 1, further comprising a positioning device comprising an engaging section on the surface of a said holder assembly engageable with an engaging recess on the inside surface of the header assembly configured to ensure proper positioning of the holder assembly in order to enable the sealing member to plug and seal the opening.

* * * * *